US005443592A

United States Patent [19]

Ittah et al.

[11] Patent Number: 5,443,592

[45] Date of Patent: Aug. 22, 1995

[54] FEMALE ELECTRICAL CONTACT MEMBER

[75] Inventors: Jean Ittah, Villeneuve la Garenne; Olivier Plessis, Chaville, both of France

[73] Assignee: Connecteurs Cinch, Montigny le Bretonneux, France

[21] Appl. No.: 317,866

[22] Filed: Oct. 4, 1994

[30] Foreign Application Priority Data

Oct. 26, 1993 [FR] France ..... 93 12749

[51] Int. Cl.[6] ..... H01R 11/22

[52] U.S. Cl. ..... 439/851; 439/839

[58] Field of Search ..... 439/851, 852, 856, 857, 439/842

[56] References Cited

U.S. PATENT DOCUMENTS

| | | | |
|---|---|---|---|
| 4,560,231 | 12/1985 | Shirai | 439/851 |
| 4,699,444 | 10/1987 | Isohata . | |
| 4,838,816 | 6/1989 | Matsusaka et al. . | |
| 4,909,762 | 3/1990 | Yagi et al. | 439/852 |
| 5,112,254 | 5/1992 | Endo | 439/852 |
| 5,158,485 | 10/1992 | Saito et al. | 439/851 |
| 5,226,842 | 7/1993 | Endo et al. | 439/852 |
| 5,271,741 | 12/1993 | Saito et al. | 439/851 |
| 5,281,175 | 1/1994 | Chupak et al. . | |

FOREIGN PATENT DOCUMENTS

| | | |
|---|---|---|
| 0147076 | 7/1985 | European Pat. Off. . |
| 2627020 | 5/1994 | France . |
| 8223932 | 12/1985 | Germany . |

*Primary Examiner*—Larry I. Schwartz
*Assistant Examiner*—Jill DeMello
*Attorney, Agent, or Firm*—Sandler, Greenblum & Bernstein

[57] ABSTRACT

A female electrical contact member has at one end crimping lugs and at the other end a rectangular cross-section receptacle with a floor wall and a ceiling wall. The floor wall is extended and bent towards the inside of the receptacle to form a spring strip. A male tab inserted into the receptacle is therefore clamped between this strip and the ceiling wall. A cut-out bar in the floor wall is bent so that it extends under the spring strip and cooperates with the latter.

4 Claims, 2 Drawing Sheets

FEMALE ELECTRICAL CONTACT MEMBER

BACKGROUND OF THE INVENTION

1. Field of the Invention

The present invention concerns a female electrical contact member.

The invention relates to a female electrical contact member having at one end means for fixing it to a conductor and at the other end a receptacle adapted to receive a male tab, a spring strip in the receptacle being pressed against the tab.

2. Description of the Prior Art

Some prior art electrical contact members have means at one end for fixing an electrical conductor and the other end shaped to form a rectangular cross-section receptacle adapted to receive a male tab.

In order to increase the pressure on the male tab in the receptacle, one wall is extended and bent into the receptacle to form a spring strip.

Because such electrical contact members are often small in size and because the material from which they are cut out is thin, in some designs a bar is cut out from the body of the member and, by cooperating with the spring strip, enhances the spring action of the latter.

Patents EP-A-0 147 076 and U.S. Pat. No. 4,699,444 show a design of this kind.

The designs described in these patents have the disadvantage that if the male tab is not offered up correctly or is too thick the spring strip is forced and no longer fulfils its function and the bar acquires a permanent set and is therefore no longer of any utility.

An object of the present invention is to remedy this.

SUMMARY OF THE INVENTION

The present invention consists in a female electrical contact member of the type made from a strip of a material which is a good conductor of electricity and has some degree of elasticity, cut and bent to have at one end lugs for crimping an electrical conductor and at the other end a rectangular cross-section receptacle having a floor wall, two side walls and a ceiling wall, the floor wall being extended and bent towards the interior of the receptacle to form a spring strip so that a male tab inserted into the receptacle is gripped between the strip and the ceiling wall, the floor wall including a cut-out bar which is bent to extend under the spring strip and cooperate therewith, the bar being cut out from the lug end and bent to extend towards the free end of the receptacle adapted to receive the male tab, the side walls including plunged bosses forming internal abutments limiting movement of the spring strip, and the bar having a width less than the gap between the plunged bosses.

With this arrangement, with the bar bent into a hairpin shape, its spring action is strengthened and as the plunged bosses limit movement of the strip the latter cannot be forced and this prevents permanent setting of the bar.

The spring strip is preferably provided with lateral wings adapted to bear against the plunged bosses.

The invention is now described in more detail with reference to a specific embodiment shown by way of example only in the appended drawings.

DETAILED DESCRIPTION OF THE PREFERRED EMBODIMENT

Figure 1:
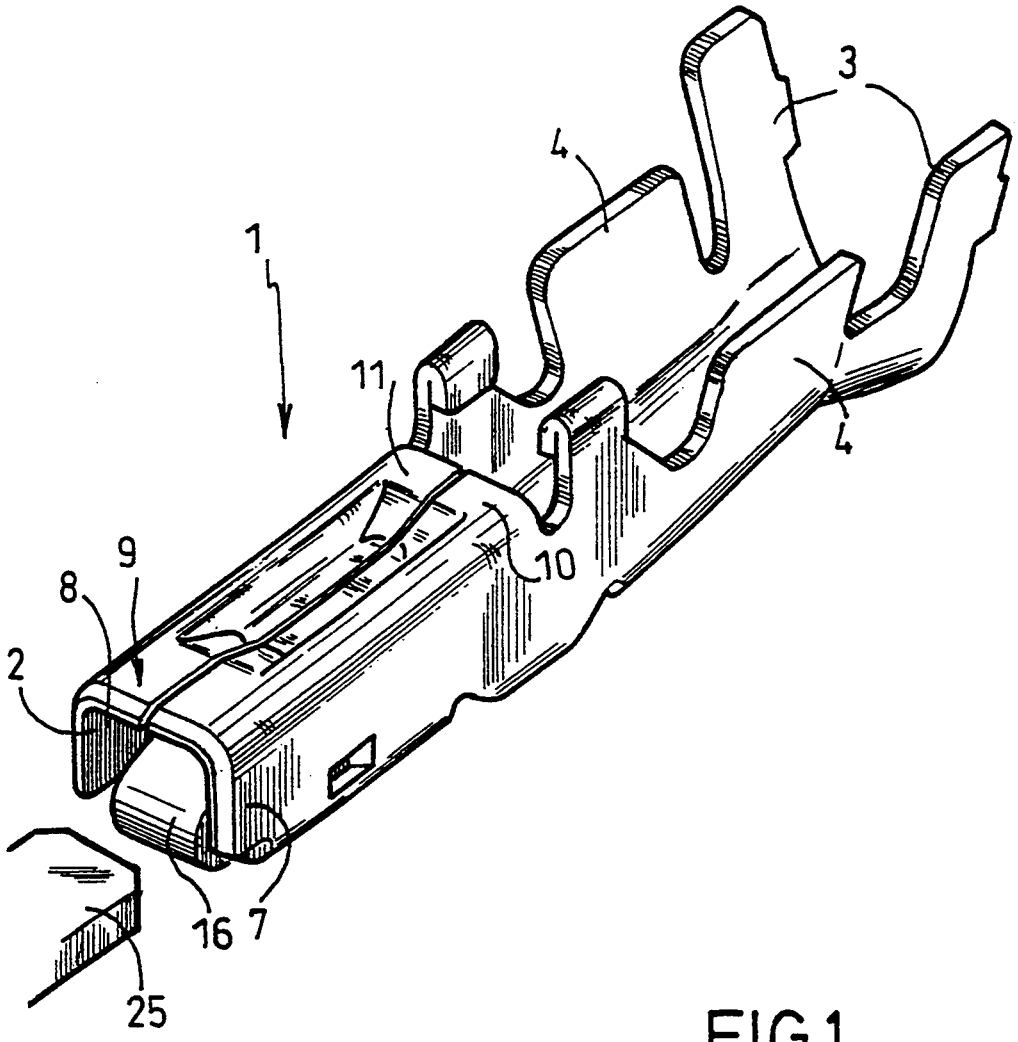
FIG. 1 is a perspective view of a female electrical contact member of the invention.
Figure 2:
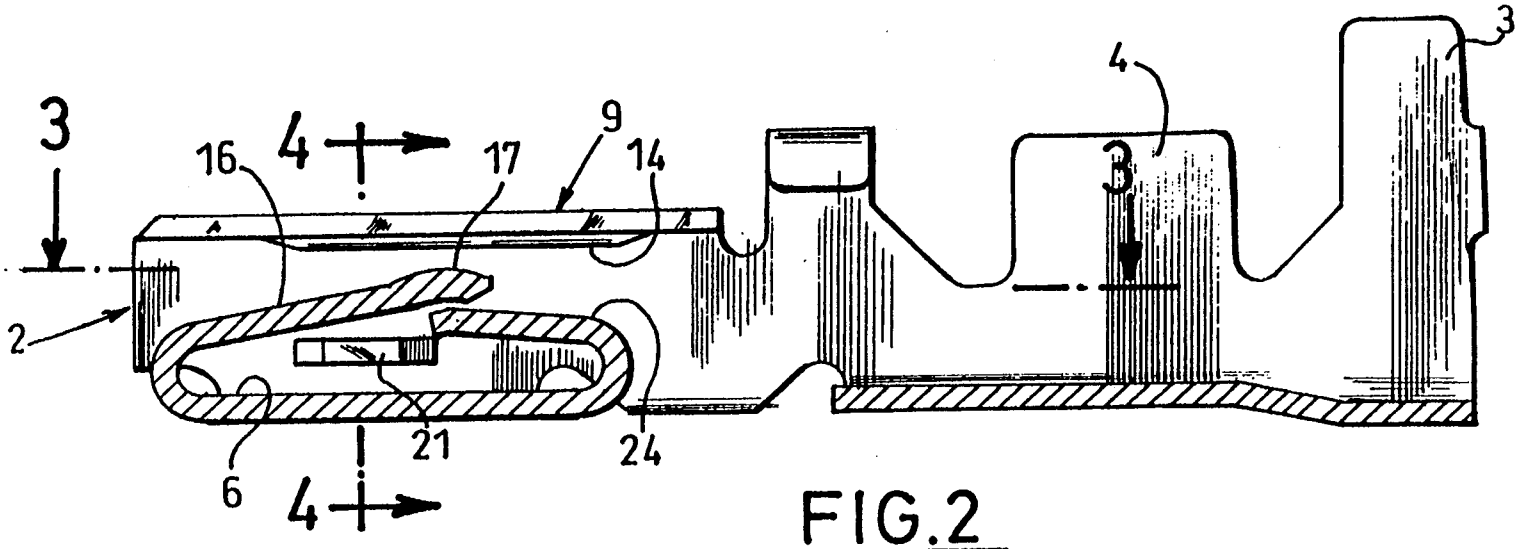
FIG. 2 is a view in longitudinal cross-section.
Figure 4:
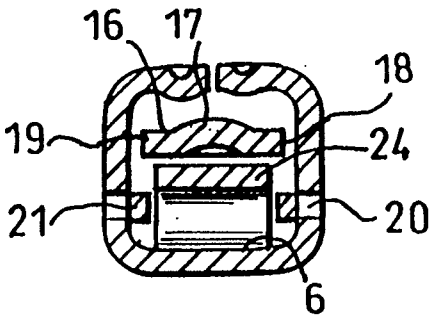
FIG. 4 is a view in cross-section on the line 4—4 in FIG. 2.
Figure 3:
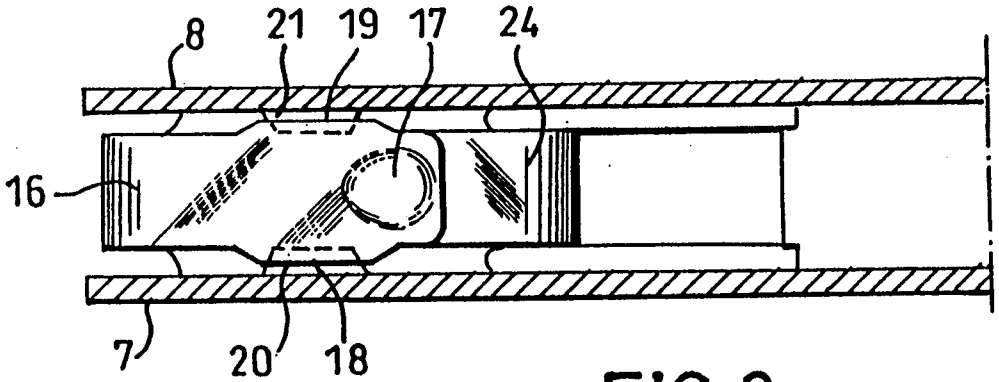
FIG. 3 is a view in cross-section on the line 3—3 in FIG. 2.

The contact member shown in the figures is made from a strip of a metal which is a good conductor of electricity cut and bent to form a body 1 with at one end a receptacle 2 and at the other end lugs 3 for crimping an insulated electrical conductor and lugs 4 for crimping a bared end of the conductor.

The receptacle 2 has a floor wall 6, two side walls 7 and 8 and a ceiling wall 9 formed by the free edges 10 and 11 of the respective side walls 7 and 8 which are bent towards each other, the free edges being stamped to form an internal projection 14 in the receptacle 2.

The floor wall 6 is extended at the end opposite the crimping lugs 3 and 4, the extension being bent inside the receptacle 2 to form an electrical contact spring strip 16 having a boss 17 near its free end and facing towards the projection 14.

The strip 16 has wings 18 and 19 at the side. A plunged boss 20 is formed in the wall 7 at the wing 18 and a plunged boss 21 is formed in the side wall 8 at the wing 19.

The plunged bosses 20 and 21 are formed at a level such that they oppose insertion into the receptacle 2 of a male tab whose thickness exceeds a predetermined threshold.

A bar 24 is cut out from the floor 6 and bent so that it extends towards the free end of the receptacle 2 in order to cooperate with the strip 16 and strengthen the spring action of the latter.

The width of the bar 24 is less than the distance between the plunged bosses 20 and 21 so that it can move freely between the latter.

When a male tab 25 is inserted into the receptacle 2 it is gripped between the boss 17 and the projection 14. The strip is pressed down elastically and abuts against the bar 24 which strengthens the spring action.

The plunged bosses 20, 21 constitute abutments limiting movement of the strip 16 and preventing insertion of male tabs having a thickness greater than the permitted thickness.

Of course, the invention is not limited to the embodiment shown that has Just been described. Numerous modifications of detail can be made thereto without departing from the scope of the invention.

We claim:

1. Female electrical contact member made from a strip of a material which is a good conductor of electricity and has some degree of elasticity, the strip of material comprising two ends and being cut and bent to have at one of the two ends lugs for crimping an electrical conductor and at the other of the two ends a rectangular cross-section receptacle comprising an interior formed by a floor wall, two side walls and a ceiling wall, said floor wall being extended and bent towards the interior of said receptacle to form a spring strip so that a male tab inserted into said receptacle is gripped between said strip and said ceiling wall, said floor wall including a cut-out bar which is bent to extend under said spring strip and cooperate therewith, said bar being cut out from the one of the two ends comprising lugs and bent to extend towards said other end of said receptacle adapted to receive said male tab, said side walls including plunged bosses forming internal abutments limiting movement of said spring strip, and said bar having a width less than the gap between said plunged bosses.

2. The female electrical contact member according to claim 1 wherein said spring strip comprises lateral wings adapted to bear against said plunged bosses.

3. Female electrical contact member, comprising:

a rectangular cross-section receptacle comprising a free end and a lug end comprising lugs for crimping an electrical conductor, said receptacle comprising an interior formed by a floor wall, two side walls and a ceiling wall, said floor wall being extended and bent towards the interior of said receptacle to form a spring strip so that a male tab inserted into said receptacle is gripped between said strip and said ceiling wall;

said floor wall including a bar which is bent to extend under said spring strip and cooperate therewith, said bar extending from the lug end and bent to extend towards said free end of said receptacle under said spring strip and cooperate therewith;

plunged bosses positioned on said side walls forming internal abutments limiting movement of said spring strip; and said bar having a width less than a gap between said plunged bosses.

4. The female electrical contact member according to claim 3 wherein said spring strip comprises lateral wings adapted to bear against said plunged bosses.

* * * * *